US012044466B2

(12) United States Patent
Rode et al.

(10) Patent No.: US 12,044,466 B2
(45) Date of Patent: Jul. 23, 2024

(54) SYSTEMS AND METHODS FOR MONITORING REFRIGERATION SYSTEMS

(71) Applicant: 7-Eleven, Inc., Irving, TX (US)

(72) Inventors: Tejas Pradip Rode, Coppell, TX (US); Xinan Wang, Dallas, TX (US); Shahmeer Ali Mirza, Celina, TX (US); Matthew O'Daniel Redmond, Denton, TX (US); John Robert Keller, Plano, TX (US)

(73) Assignee: 7-ELEVEN, INC., Irving, TX (US)

( * ) Notice: Subject to any disclaimer, the term of this patent is extended or adjusted under 35 U.S.C. 154(b) by 445 days.

(21) Appl. No.: 17/455,824

(22) Filed: Nov. 19, 2021

(65) Prior Publication Data

US 2023/0160629 A1 May 25, 2023

(51) Int. Cl.
*F25D 29/00* (2006.01)
*F25D 27/00* (2006.01)

(52) U.S. Cl.
CPC ..... *F25D 29/008* (2013.01); *F25D 27/005* (2013.01); *F25B 2500/13* (2013.01); *F25D 2400/36* (2013.01); *F25D 2700/02* (2013.01); *F25D 2700/12* (2013.01)

(58) Field of Classification Search
CPC .... F25B 49/02; F25B 49/022; F25B 2500/13; F25B 2700/15; F25D 29/008; F25D 29/00; F25D 2700/02; F25D 2700/12; F25D 2600/06; F25D 2400/36; F25D 27/005; F24F 2110/10; G01K 1/026; G01R 21/00
See application file for complete search history.

(56) References Cited

U.S. PATENT DOCUMENTS

2020/0173719 A1* 6/2020 Jaakkola ..... G01N 33/0063
2021/0072119 A1* 3/2021 Kriss ..... F25D 29/008
2021/0088390 A1* 3/2021 Kriss ..... F24F 11/49

* cited by examiner

*Primary Examiner* — Nelson J Nieves
*Assistant Examiner* — Meraj A Shaikh
(74) *Attorney, Agent, or Firm* — Baker Botts L.L.P.

(57) ABSTRACT

A system includes a door sensor that provides a status of whether a door of a refrigeration system is open or closed, a temperature sensor that measures a temperature of a food compartment of the refrigeration system, a power sensor that measures an amount of power consumed by the refrigeration system, and a compressor sensor that provides acoustic data about a compressor of the refrigeration system. The system further includes a remote computing system configured to send an alert indicating that the refrigeration system needs servicing when the temperature of the food compartment of the refrigeration system is determined to be above a predetermined temperature while: the door of the refrigeration system is closed, the amount of power consumed by the refrigeration system is within a predetermined power range, and acoustic signals of the compressor of the refrigeration system are within a predetermined acoustic range.

20 Claims, 2 Drawing Sheets

SYSTEMS AND METHODS FOR MONITORING REFRIGERATION SYSTEMS

TECHNICAL FIELD

The present disclosure relates generally to sensors, and more specifically to systems and methods for monitoring refrigeration systems.

BACKGROUND

Refrigeration systems are used by many businesses to store and display food and drink items for purchase. For example, a convenience store may utilize multiple reach-in coolers to store and display various food and drink items for customers to purchase. Refrigeration systems such as reach-in coolers can fail to maintain proper temperatures for many reasons. For example, a door may be left ajar by a customer, thereby allowing refrigerated air to escape. As another example, a compressor of the refrigeration system may malfunction, thereby allowing the temperature within the refrigeration system to rise above desired levels.

SUMMARY

Refrigeration systems are used by many businesses to store and display food and drink items for purchase. For example, a convenience store may utilize multiple reach-in coolers to store and display various food and drink items for purchase. Refrigeration systems such as reach-in coolers can fail to maintain proper temperatures for many reasons. For example, a door may be left ajar by a customer, thereby allowing refrigerated air to escape. As another example, a compressor of the refrigeration system may malfunction, thereby allowing the temperature within the refrigeration system to rise above desired levels.

This disclosure contemplates utilizing multiple sensors to monitor a refrigeration system and create various alerts about the refrigeration system for display on a user device based on data provided by the sensors. In one example, up to four different sensors coupled to a refrigeration system are used to identify and report various issues: a door sensor, a temperature sensor, a power sensor, and a compressor sensor that monitors a compressor of the refrigeration system. The disclosed embodiments utilize various methods to monitor the data provided by sensors and to alert workers of problems with the refrigeration system that are identified using data from the sensors. For example, if a temperature of a food compartment of the refrigeration system is above normal and a door is detected to be open, an alert may be sent to indicate to a worker to close the door. As another example, if the temperature of a food compartment is above normal, all doors are detected to be closed, and the amount of power consumed by the refrigeration system is not within a normal operating range, an alert may be sent to indicate to a worker to inspect a power cord of the refrigeration system. As yet another example, if the temperature of a food compartment is above normal, all doors are detected to be closed, the amount of power consumed by the refrigeration system is within a normal operating range, and acoustic signals of the compressor are within a normal range, an alert may be sent to indicate to a worker that the refrigeration system needs servicing.

In some embodiments, a system includes a door sensor that provides a status of whether a door of a refrigeration system is open or closed, a temperature sensor that measures a temperature of a food compartment of the refrigeration system, a power sensor that measures an amount of power consumed by the refrigeration system, and a compressor sensor that provides acoustic data about a compressor of the refrigeration system. The system further includes a remote computing system configured to send an alert indicating that the refrigeration system needs servicing when the temperature of the food compartment of the refrigeration system is determined to be above a predetermined temperature while: the door of the refrigeration system is closed, the amount of power consumed by the refrigeration system is within a predetermined power range, and acoustic signals of the compressor of the refrigeration system are within a predetermined acoustic range.

The disclosed embodiments provide several practical applications and technical advantages, which include at least: 1) technology that utilizes multiple sensors to monitor a refrigeration system and create various alerts about the refrigeration system for display on a user device based on data provided by the sensors; 2) technology that automatically provides visual and audible indications of different malfunctions of a refrigeration system; and 3) technology that protects refrigeration systems from further damage by automatically turning off a refrigeration system when certain malfunctions are detected.

Embodiments of the present disclosure provide technological solutions to technological problems. For example, some embodiments automatically send instructions to a refrigeration system when certain malfunctions are detected. As a specific example, some refrigeration systems have automatic cleaning modes for cleaning evaporator coils of compressors. When a refrigeration system is not cooling properly, and other root causes such as a door being open have been eliminated, certain embodiments may determine that there is a malfunction with the compressor and therefore send instructions to the refrigeration system to enable the automatic cleaning of the evaporator coil attached to the compressor. This may reduce the load on the compressor and allow it to cool the refrigeration system more efficiently. As another specific example, when a refrigeration system is not cooling properly and it is determined that the compressor is at fault, some embodiments may send instructions for the refrigeration system to raise the temperature setpoint of the refrigeration system in order to ease the load on the compressor. Specifically, if the current temperature setpoint is 34° F. and food inside the refrigeration system must remain below 40° F. for food safety reasons, the temperature setpoint may be raised up to 36° F. (or even up to 40° F.) to ease the load on the compressor. As a result, the refrigeration system may be protected from burnout and the life of the refrigeration system may be extended. In addition, by reducing the load on the compressor of a refrigeration system by commanding an automatic evaporator coil cleaning or by raising the temperature setpoint, resources such as electricity may be conserved.

Certain embodiments may include none, some, or all of the above technical advantages and practical applications. One or more other technical advantages and practical applications may be readily apparent to one skilled in the art from the figures, descriptions, and claims included herein.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
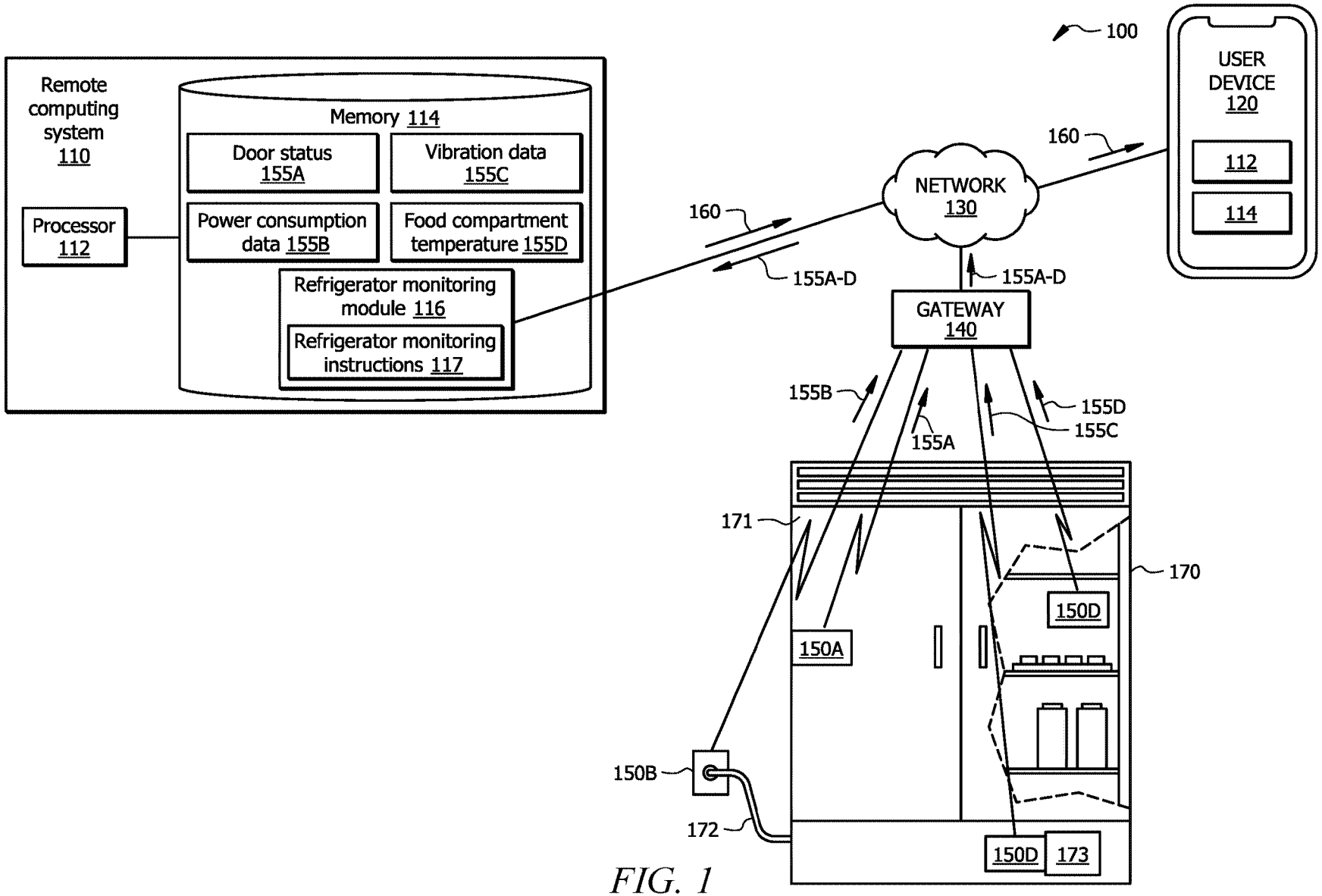
FIG. 1 is a schematic diagram of a refrigerator monitoring system, according to certain embodiments.
Figure 2:
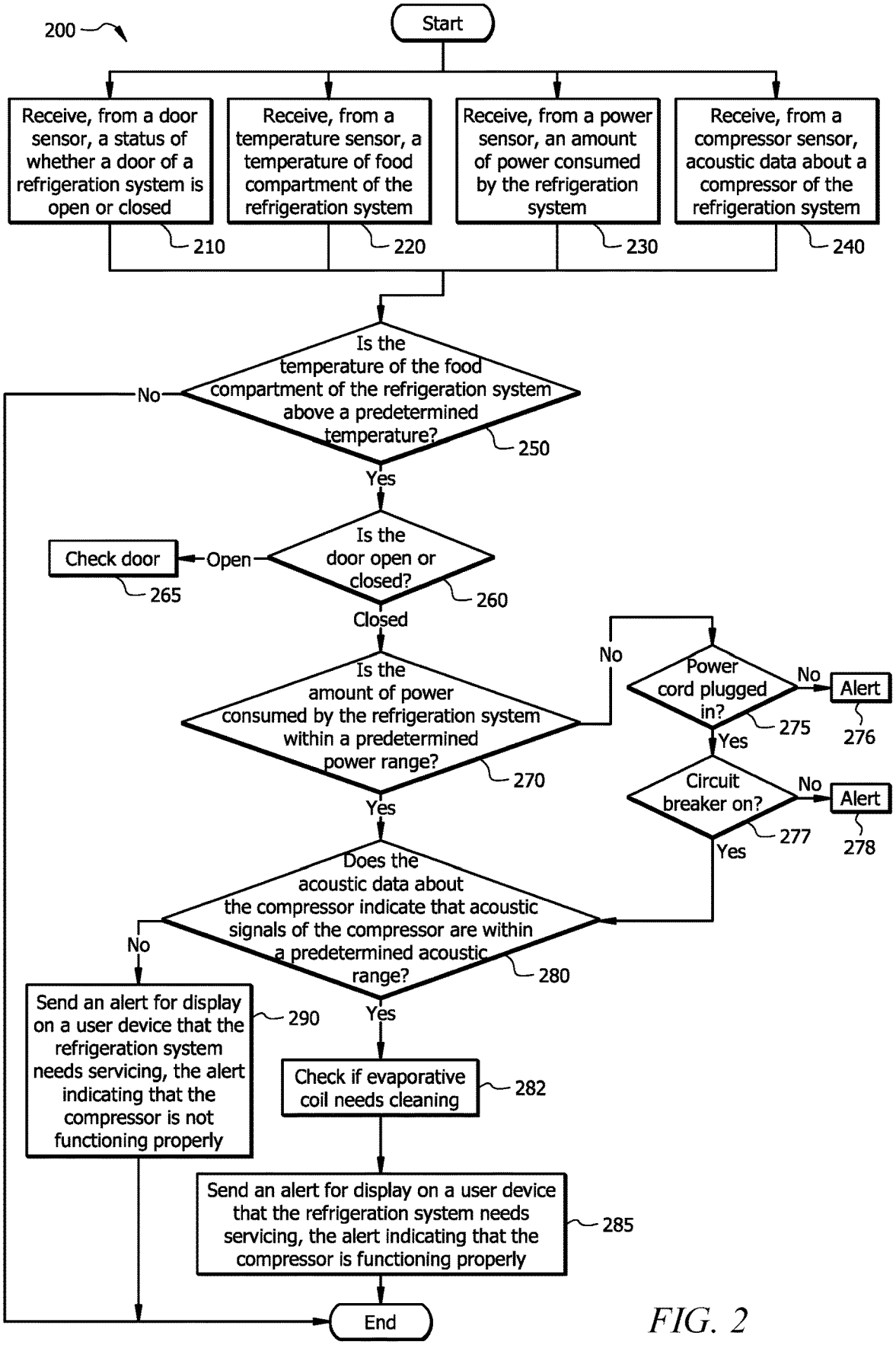
FIG. 2 is a flowchart of a method for monitoring a refrigeration system, according to certain embodiments.

Embodiments of the present disclosure and its advantages are best understood by referring to FIGS. 1 and 2 of the drawings, like numerals being used for like and corresponding parts of the various drawings.

Refrigeration systems are used by many businesses to store and display food and drink items for purchase. For example, a convenience store may utilize multiple reach-in coolers to store and display various food and drink items for purchase. Refrigeration systems such as reach-in coolers can fail to maintain proper temperatures for many reasons. For example, a door may be left ajar by a customer, thereby allowing refrigerated air to escape. As another example, a compressor of the refrigeration system may malfunction, thereby allowing the temperature within the refrigeration system to rise above desired levels.

This disclosure contemplates utilizing multiple sensors to monitor a refrigeration system and creating various alerts for display on a user device based on data provided by the sensors. In one example, up to four different sensors coupled to a refrigeration system are used to identify and report various issues: a door sensor, a temperature sensor, a power sensor, and a compressor sensor coupled to a compressor of the refrigeration system. The disclosed embodiments utilize various methods to monitor the data provided by sensors and to alert workers of problems with the refrigeration system as identified using the sensors. For example, if a temperature of a food compartment of the refrigeration system is above normal and a door is detected to be open, an alert may be sent to indicate to a worker to close the door. As another example, if the temperature of a food compartment is above normal, all doors are detected to be closed, and the amount of power consumed by the refrigeration system is not within a normal operating range, an alert may be sent to indicate to a worker to inspect a power cord of the refrigeration system. As yet another example, if the temperature of a food compartment is above normal, all doors are detected to be closed, the amount of power consumed by the refrigeration system is within a normal operating range, and acoustic signals of the compressor are within a normal range, an alert may be sent to indicate to a worker that the refrigeration system needs servicing.

FIG. 1 illustrates an example refrigerator monitoring system 100, according to certain embodiments. As illustrated in FIG. 1, certain embodiments of refrigerator monitoring system 100 include a remote computing system 110, a user device 120, a network 130, a gateway 140, multiple sensors 150 (e.g., 150A-D), and a refrigeration system 170. Remote computing system 110 is communicatively coupled to user device 120 and gateway 140 via a network 130 using any appropriate wired or wireless telecommunication technology. In some embodiments, sensors 150 send sensor data 155 (e.g., 155A-D) directly to remote computing system 110 or indirectly to remote computing system 110 via network 130 using any appropriate wired or wireless telecommunication technology. In other embodiments, sensors 150 send sensor data 155 to gateway 140 using an Internet-of-Things (IoT) communications protocol, and gateway 140 in turn sends sensor data 155 via network 130.

In general, remote computing system 110 receives sensor data 155 about refrigeration system 170 generated by sensors 150 and in turn provides alerts 160 for display on user device 120 based on sensor data 155. In some embodiments, if temperature sensor 150D measures a temperature 155D of a food compartment of refrigeration system 170 that is above normal and a door 171 of refrigeration system 170 is detected to be open by door sensor 150A, an alert 160 may be sent to instruct a worker to inspect and close door 171. In some embodiments, if temperature sensor 150D measures a temperature 155D that is above normal, door 171 is detected to be closed by door sensor 150A, and power sensor 150B detects that the amount of power consumed by refrigeration system 170 is not within a normal operating range, an alert 160 may be sent to indicate to a worker to inspect a power cord 172 of refrigeration system 170. In some embodiments, if temperature sensor 150D measures a temperature 155D that is above normal, door 171 is detected to be closed by door sensor 150A, power sensor 150B detects that the amount of power consumed by refrigeration system 170 is within a normal operating range, and compressor sensor 150C detects that acoustic signals of compressor 173 are within a normal range, an alert 160 may be sent to indicate to a worker or repair person that refrigeration system 170 needs servicing.

Remote computing system 110 may be any appropriate computing system in any suitable physical form. As example and not by way of limitation, remote computing system 110 may be an embedded computer system, a system-on-chip (SOC), a single-board computer system (SBC) (such as, for example, a computer-on-module (COM) or system-on-module (SOM)), a desktop computer system, a laptop or notebook computer system, a mainframe, a mesh of computer systems, a mobile telephone, a personal digital assistant (PDA), a server, a tablet computer system, an augmented/virtual reality device, or a combination of two or more of these. Where appropriate, remote computing system 110 may include one or more remote computing systems 110; be unitary or distributed; span multiple locations; span multiple machines; span multiple data centers; or reside in a cloud, which may include one or more cloud components in one or more networks. Where appropriate, one or more remote computing systems 110 may perform without substantial spatial or temporal limitation one or more steps of one or more methods described or illustrated herein. As an example and not by way of limitation, one or more remote computing systems 110 may perform in real time or in batch mode one or more steps of one or more methods described or illustrated herein. One or more remote computing systems 110 may perform at different times or at different locations one or more steps of one or more methods described or illustrated herein, where appropriate. In some embodiments, remote computing system 110 includes an electronic display (not illustrated) for additionally or alternatively displaying alert 160.

Remote computing system 110 may be physically located within the same physical building in which sensors 150 are located, or physically located at a location remote from the physical building in which sensors 150 are located. For example, in certain embodiments, remote computing system 110 may located in one or more remote servers (e.g. in the cloud).

Processor 112 is any electronic circuitry, including, but not limited to a microprocessor, an application specific integrated circuits (ASIC), an application specific instruction set processor (ASIP), and/or a state machine, that communicatively couples to memory 114 and controls the operation of remote computing system 110. Processor 112 may be 8-bit, 16-bit, 32-bit, 64-bit or of any other suitable architecture. Processor 112 may include an arithmetic logic unit (ALU) for performing arithmetic and logic operations, processor registers that supply operands to the ALU and store the results of ALU operations, and a control unit that fetches instructions from memory and executes them by directing the coordinated operations of the ALU, registers and other components. Processor 112 may include other hardware that operates software to control and process information. Processor 112 executes software stored in memory to perform any of the functions described herein. Processor 112 controls the operation and administration of remote computing system 110 by processing information received from sensor 150, gateway 140, network 130, user device 120, and memory 114. Processor 112 may be a programmable logic device, a microcontroller, a microprocessor, any suitable processing device, or any suitable combination of the preceding. Processor 112 is not limited to a single processing device and may encompass multiple processing devices.

Memory 114 may store, either permanently or temporarily, data such as sensor data 155, user preferences, business rules, operational software such as refrigerator monitoring module 116, or other information for processor 112. Memory 114 may include any one or a combination of volatile or non-volatile local or remote devices suitable for storing information. For example, memory 114 may include random access memory (RAM), read only memory (ROM), magnetic storage devices, optical storage devices, or any other suitable information storage device or a combination of these devices.

Refrigerator monitoring module 116 represents any suitable set of instructions, logic, or code embodied in a computer-readable storage medium. For example, refrigerator monitoring module 116 may be embodied in memory 114, a disk, a CD, or a flash drive. In particular embodiments, refrigerator monitoring module 116 may include refrigerator monitoring instructions 117 (e.g., a software application) executable by processor 112 to perform one or more of the functions described herein. In general, refrigerator monitoring module 116 sends alert 160 for display on user device 120 either directly or via network 130. As described in more detail herein, alerts 160 are generated by refrigerator monitoring module 116 based on sensor data 155 from sensors 150.

User device 120 is any appropriate device for communicating with components of remote computing system 110 over network 130. For example, user device 120 may be a handheld computing device such as a smartphone, wearable computer glasses, a smartwatch, a tablet computer, a laptop computer, and the like. User device 120 may include an electronic display, a processor such as processor 112, and memory such as memory 114. The electronic display of user device 120 may display an alert 160 that is provided by remote computing system 110.

Network 130 allows communication between and amongst the various components of system 100. For example, remote computing system 110, user device 120, and gateway 140 may communicate via network 130. This disclosure contemplates network 130 being any suitable network operable to facilitate communication between the components of system 100. Network 130 may include any interconnecting system capable of transmitting audio, video, signals, data, messages, or any combination of the preceding. Network 130 may include all or a portion of a local area network (LAN), a wide area network (WAN), an overlay network, a software-defined network (SDN), a virtual private network (VPN), a packet data network (e.g., the Internet), a mobile telephone network (e.g., cellular networks, such as 4G or 5G), a Plain Old Telephone (POT) network, a wireless data network (e.g., WiFi, WiGig, WiMax, etc.), a Long Term Evolution (LTE) network, a Universal Mobile Telecommunications System (UMTS) network, a peer-to-peer (P2P) network, a Bluetooth network, a Near Field Communication (NFC) network, a Zigbee network, and/or any other suitable network.

Door sensor 150A is any appropriate device for sensing whether door 171 is open or closed. For example, door sensor 150A may be a contact sensor or a non-contact sensor (e.g., utilizing an electromagnet). In some embodiments, door sensor 150A is coupled to door 171, but in other embodiments may be coupled to another portion of refrigeration system 170 (e.g., a hinge). Door sensor 150A provides door status 155A to remote computing system 110. Door status 155A includes an indication of whether door 171 is open or closed. Door status 155A may be any output signal from door sensor 150A (e.g., a voltage corresponding to the door being open or closed).

Power sensor 150B is a device for sensing or measuring the amount of load power consumed by refrigeration system 170 (e.g., a current transformer, a voltage transformer, etc.). In some embodiments, power sensor 150B plugs into a power outlet and power cord 172 of refrigeration system 170 is plugged into power sensor 150B. Power sensor 150B provides power consumption data 155B to remote computing system 110. In some embodiments, power consumption data 155B indicates a current amount of power (e.g., watts) being consumed by refrigeration system 170.

Compressor sensor 150C is a device that senses and provides acoustic data 155C about compressor 173 to remote computing system 110. In some embodiments, compressor sensor 150C is an accelerometer that is physically coupled to compressor 173. In other embodiments, compressor sensor 150C is not coupled to compressor 173, but is located proximate to compressor 173 (e.g., a microphone). In general, acoustic data 155C indicates whether compressor 173 is operating normally or abnormally with respect to acoustic signals of compressor 173. For example, some embodiments of acoustic data 155C indicate a frequency, periodicity, and/or amplitude of acoustic signals of compressor 173 that can be compared to stored acoustic data of a normally-operating compressor 173. If acoustic data 155C deviates from a normal, default acoustic profile for compressor 173 (e.g., higher or lower periodicity, higher or lower amplitude, etc.), refrigerator monitoring system 100 may determine that refrigeration system 170 is stressed or performing incorrectly.

Temperature sensor 150D is any appropriate device for sensing or measuring temperatures. In some embodiments, temperature sensor 150D is installed within a food compartment of refrigeration system 170 and reports food compartment temperature 155D to remote computing system 110. In some embodiments, temperature sensor 150D is a digital thermometer or a thermocouple. Food compartment temperature 155D may be any appropriate temperature measurement (e.g., Fahrenheit or Celsius), and in some embodiments may include a time stamp to indicate when a particular food compartment temperature 155D was measured.

In some embodiments, sensors 150 send sensor data 155 on a periodic basis. For example, sensors 150 may send sensor data 155 every five minutes. In some embodiments, sensor data 155 includes a timestamp that indicates a time that sensor data 155 was sent or captured. In some embodiments, sensor data 155 is stored in memory 114 of remote computing system 110 and may overwrite the previous sensor data 155 (i.e., some embodiments may only log the latest valid sensor data 155).

In some embodiments, one or more sensors 155 are IoT sensors. In general, IoT describes a network of physical objects that are embedded with sensors, software, and other technologies for the purpose of connecting and exchanging data with other devices and systems over the Internet, or any other appropriate network. For example, some embodiments of sensor 150 include a microprocessor (e.g., processor 112), a transceiver (e.g., a Bluetooth transceiver) for wirelessly communicating sensor data 155 (e.g., via an IoT communications protocol), an antenna, and a power supply such as a battery. In embodiments where one or more sensors 150 are IoT devices, refrigerator monitoring system 100 may include gateway 140 for communicating with sensors 150. Gateway 140 may be any appropriate IoT gateway, computer system, or electronic device that is capable of wirelessly communicating with sensors 150 using any appropriate IoT communications protocol (e.g., Message Queuing Telemetry Transport (MQTT), Constrained Application Protocol (CoAP), Advanced Message Queuing Protocol (AMQP), Data Distribution Service (DDS), HyperText Transfer Protocol (HTTP), WiFi, Bluetooth, ZigBee, Z-Wave, a media access control (MAC) protocol such as LoRaWAN, and the like). For example, temperature sensor 150D may wirelessly transmit food compartment temperature 155D to gateway 140, and gateway 140 may in turn send food compartment temperature 155D to remote computing system 110 via network 130. In other embodiments, one or more sensors 150 are not IoT devices. In embodiments where one or more sensors 150 are not IoT devices, the one or more sensors 150 do not utilize gateway 140 but instead transmit sensor data 155 directly to remote computing system 110 or indirectly via network 130 (e.g., via Bluetooth or WiFi).

Alert 160 is a message or other indication that is displayed on user device 120 regarding refrigeration system 170. In some embodiments, alert 160 includes one or more of an indication of refrigeration system 170, door status 155A, power consumption data 155B, food compartment temperature 155D, a timestamp, and a recommended action regarding refrigeration system 170. For example, when refrigerator monitoring system 100 determines that food compartment temperature 155D is above a predetermined temperature and door 171 is open, alert 160 may be: "Temperature violation on cooler #1 at 10:20 AM: a door is open." As another example, when refrigerator monitoring system 100 determines that food compartment temperature 155D is above a predetermined temperature, door 171 is closed, and power consumption data 155B indicates that the amount of power currently consumed by refrigeration system 170 is not within a predetermined power range, alert 160 may be: "Temperature violation on cooler #1 at 10:20 AM: inspect the power cord to ensure that it is fully plugged into the power receptacle and not damaged." Additional examples of alert 160 are discussed below.

In operation, remote computing system 110 analyzes sensor data 155 provided by sensors 150 and provides alerts 160 about refrigeration system 170 for display on user device 120 based on sensor data 155. Generally, remote computing system 110 analyzes sensor data 155 in order to isolate a possible root cause of inadequate temperatures within refrigeration system 170 and then provide an alert 160 to address or otherwise indicate the cause of the malfunction. In some embodiments, refrigerator monitoring system 100 utilizes sensors 150A-D in order to isolate three possible causes of inadequate temperatures within refrigeration system 170: 1) when a door 171 is not properly closed, 2) when power cord 172 is damaged or not fully engaged with an electrical outlet, and 3) when compressor 173 is malfunctioning. Each situation is described in more detail below.

First, certain embodiments of refrigerator monitoring system 100 utilize sensor data 155 from sensors 150 to determine whether the root cause of inadequate temperatures within refrigeration system 170 is door 171 being open. In these embodiments, remote computing system 110 first analyzes food compartment temperature 155D and determines whether food compartment temperature 155D is above a predetermined temperature. For example, remote computing system 110 may determine whether food compartment temperature 155D is above a static temperature such as 32° F. If food compartment temperature 155D is above the predetermined temperature, remote computing system 110 then determines from door status 155A whether door 171 is open or closed. If remote computing system 110 determines that door 171 is open in addition to food compartment temperature 155D being above the predetermined temperature, remote computing system 110 sends alert 160 for display on user device 120 to indicate that door 171 is open. Additionally, if remote computing system 110 determines that door 171 is open in addition to food compartment temperature 155D being above the predetermined temperature, remote computing system 110 may send one or more instructions to refrigeration system 170 to produce an audible or visual indication that door 171 is open. For example, the one or more instructions may include an instruction that causes one more lights of the refrigeration system to blink or an instruction that causes an alarm of the refrigeration system to sound. As a result, a worker may be able to quickly identify and close door 171, thereby reducing energy consumption of refrigeration system 170, prolonging the operational life of refrigeration system 170 (i.e., by closing door 171, the operating time and wear on components such as compressor 173 will be reduced), and avoiding potential food spoilage.

Second, certain embodiments of refrigerator monitoring system 100 utilize sensor data 155 from sensors 150 to determine whether the root cause of inadequate temperatures within refrigeration system 170 is power cord 172. In these embodiments, remote computing system 110 first analyzes food compartment temperature 155D and determines whether food compartment temperature 155D is above a predetermined temperature. If food compartment temperature 155D is above the predetermined temperature, remote computing system 110 then determines from door status 155A whether door 171 is open or closed. If remote computing system 110 determines that door 171 is closed in addition to food compartment temperature 155D being above the predetermined temperature, remote computing system 110 then determines from power consumption data 155B whether the current amount of power consumed by refrigeration system 170 is within a predetermined power range (e.g., greater than 100 watts but less than 800 watts). If remote computing system 110 determines that door 171 is closed in addition to food compartment temperature 155D being above the predetermined temperature and the current amount of power consumed by refrigeration system 170 is not within the predetermined power range, remote computing system 110 sends alert 160 for display on user device 120 to indicate that power cord 172 is damaged or not fully engaged with an electrical outlet. Additionally, if remote computing system 110 determines that door 171 is closed in addition to food compartment temperature 155D being above the predetermined temperature and the current amount of power consumed by refrigeration system 170 is not within the predetermined power range, remote computing system 110 may send one or more instructions to refrigeration system 170 to produce an audible or visual indication to indicate a problem with power cord 172. For example, the one or more instructions may include an instruction that causes one more lights of the refrigeration system to blink or an instruction that causes an alarm of the refrigeration system to sound. As a result, a worker may be able to quickly identify a problem with power cord 172, thereby prolonging the operational life of refrigeration system 170 (i.e., by closing door 171, the operating time and wear on components such as compressor 173 will be reduced) and avoiding potential food spoilage.

Third, certain embodiments of refrigerator monitoring system 100 utilize sensor data 155 from sensors 150 to determine whether the root cause of inadequate temperatures within refrigeration system 170 is compressor 173. In these embodiments, remote computing system 110 first analyzes food compartment temperature 155D and determines whether food compartment temperature 155D is above a predetermined temperature. If food compartment temperature 155D is above the predetermined temperature, remote computing system 110 then determines from door status 155A whether door 171 is open or closed. If remote computing system 110 determines that door 171 is closed in addition to food compartment temperature 155D being above the predetermined temperature, remote computing system 110 then determines from power consumption data 155B whether the current amount of power consumed by refrigeration system 170 is within a predetermined power range (e.g., greater than 100 watts but less than 800 watts). If remote computing system 110 determines that door 171 is closed in addition to food compartment temperature 155D being above the predetermined temperature and the current amount of power consumed by refrigeration system 170 is within the predetermined power range, remote computing system 110 then determines from acoustic data 155C whether measured acoustic signals of compressor 173 are within a predetermined acoustic range (e.g., higher or lower than a predetermined periodicity, higher or lower than a predetermined amplitude, higher or lower than a predetermined frequency, etc.). If remote computing system 110 determines that door 171 is closed in addition to food compartment temperature 155D being above the predetermined temperature, the current amount of power consumed by refrigeration system 170 is within the predetermined power range, and measured acoustic signals of compressor 173 are within the predetermined acoustic range, remote computing system 110 sends alert 160 for display on user device 120 to indicate that refrigeration system 170 needs servicing and that compressor 173 is functioning properly. If, however, remote computing system 110 determines that door 171 is closed in addition to food compartment temperature 155D being above the predetermined temperature, the current amount of power consumed by refrigeration system 170 is within the predetermined power range, and measured acoustic signals of compressor 173 are not within the predetermined acoustic range, remote computing system 110 sends alert 160 for display on user device 120 to indicate that refrigeration system 170 needs servicing and that compressor 173 is not functioning properly.

In some embodiments, if remote computing system 110 determines that door 171 is closed in addition to food compartment temperature 155D being above the predetermined temperature, the current amount of power consumed by refrigeration system 170 is within the predetermined power range, and measured acoustic signals of compressor 173 are within the predetermined acoustic range, remote computing system 110 may automatically send one or more instructions to refrigeration system 170 in order to switch refrigeration system 170 to an off mode. That is, if refrigeration system 170 is determined to be malfunctioning but the malfunction is not due to a faulty power cord 172 or door 171 being left open, remote computing system 110 may automatically turn off refrigeration system 170 in order to avoid any further damage to refrigeration system 170. As a result, the cost to repair refrigeration system 170 may be reduced, and the operational lifetime of refrigeration system 170 may be increased.

Some embodiments automatically send instructions to refrigeration system 170 when certain malfunctions are detected. As a specific example, some refrigeration systems 170 have automatic cleaning modes for cleaning evaporator coils of compressors 173. When refrigeration system 170 is not cooling properly, and other root causes such as a door being open have been eliminated, certain embodiments may determine that there is a malfunction with compressor 173 and therefore send instructions to refrigeration system 170 to enable the automatic cleaning of the evaporator coil attached to compressor 173. This may reduce the load on compressor 173 and allow it to cool refrigeration system 170 more efficiently. As another specific example, when refrigeration system 170 is not cooling properly and it is determined that compressor 173 is at fault, some embodiments may send instructions for refrigeration system 170 to raise the temperature setpoint of refrigeration system 170 in order to ease the load on compressor 173. Specifically, if the current temperature setpoint is 34° F. and food inside refrigeration system 170 must remain below 40° F., the temperature setpoint may be raised up to 36° F. to ease the load on compressor 173. As a result, refrigeration system 170 may be protected from burnout and the life of refrigeration system 170 may be extended. In addition, by reducing the load on compressor 173 of a refrigeration system by commanding an automatic evaporator coil cleaning or by raising the temperature setpoint, resources such as electricity may be conserved.

In certain embodiments, user device 120 may receive data 155 generated by sensors 150 and use data 155 to monitor refrigeration system 170 and create various alerts 160 about refrigeration system 170 for display on user device 120. In these embodiments, sensors 150 may directly communicate with user device 120 instead of with remote computing system 110. For example, in such embodiments, memory 114 of user device 120 may include instructions (e.g., refrigerator monitoring module 116) that, when executed by a processor 112 of user device 1204, enable user device 120 to monitor refrigeration system 170 and create various alerts 160 about refrigeration system 170 for display on the user device 120, as described herein. For example, instructions stored in memory 114 of user device 120 may determine that door 171 is open in addition to food compartment temperature 155D being above the predetermined temperature. In response to this event, user device 120 may automatically generate and display an alert 160 to instruct to a user associated with user device 120 to close door 171.

FIG. 2 illustrates a method 200 for monitoring a refrigeration system, according to certain embodiments. In general, method 200 may be utilized by remote computing system 110 (e.g., refrigerator monitoring module 116) to automatically provide alert 160 about refrigeration system 170 for display on user device 120. Method 200 may begin by collecting data in parallel from various sensors in operations 210-240.

At operation 210, method 200 receives, from a door sensor, a status of whether a door of a refrigeration system is open or closed. In some embodiments, the status is door status 155A. In some embodiments, the door sensor is door sensor 150A that monitors door 171 of refrigeration system 170. If the status is not received from the door sensor within a predetermined amount of time (e.g., 30 seconds), method 200 may utilize the previously-received door status and then send an alert to check that the door sensor is functional.

At operation 220, method 200 receives, from a temperature sensor, a temperature of a food compartment of the refrigeration system. In some embodiments, the temperature is food compartment temperature 155D. In some embodiments, the temperature sensor is temperature sensor 150D. If the temperature is not received from the temperature sensor within a predetermined amount of time (e.g., 30 seconds), method 200 may utilize the previously-received temperature and then send an alert to check that the temperature sensor is functional.

At operation 230, method 200 receives, from a power sensor, an indication of an amount of power consumed by the refrigeration system. In some embodiments, the indication of an amount of power consumed by the refrigeration system is power consumption data 155B. In some embodiments, the power sensor is power sensor 150B. If the indication of an amount of power is not received from the power sensor within a predetermined amount of time (e.g., 30 seconds), method 200 may utilize the previously-received indication of the amount of power and then send an alert to check that the power sensor is functional.

At operation 240, method 200 receives, from a compressor sensor, acoustic data about a compressor of the refrigeration system. In some embodiments, the acoustic data is acoustic data 155C. In some embodiments, the compressor sensor is compressor sensor 150C that is an accelerometer physically coupled to compressor 173 or a microphone disposed proximate to compressor 173. If the acoustic data is not received from the compressor sensor within a predetermined amount of time (e.g., 30 seconds), method 200 may utilize the previously-received acoustic data and then send an alert to check that the compressor sensor is functional.

At operation 250, method 200 determines whether the temperature of the food compartment of the refrigeration system from operation 220 is above a predetermined temperature. In some embodiments, the predetermined temperature is a static temperature such as 32° F. If the temperature of the food compartment of the refrigeration system is greater the predetermined temperature, method 200 proceeds to operation 260. If the temperature of the food compartment of the refrigeration system is less than or equal to the predetermined temperature, method 200 may end.

At operation 260, method 200 determines from the door status of operation 210 whether the door of the refrigeration system is open or closed. If the door of the refrigeration system is closed, method 200 proceeds to operation 270. If the door of the refrigeration system is open, method 200 proceeds to operation 265 where method 200 indicates to check the door of the refrigeration system. In some embodiments, an alert is sent for display on a user device to check that the door is open. In other embodiments, a camera is used to check if the door is open.

At operation 270, method 200 determines whether the amount of power consumed by the refrigeration system of operation 230 is within a predetermined power range. If the amount of power consumed by the refrigeration system is within the predetermined power range, method 200 proceeds to operation 280. If the amount of power consumed by the refrigeration system is not within the predetermined power range, method 200 proceeds to operation 275 where method 200 determines whether a power cord of the refrigeration system is plugged in. In some embodiments, a camera may be used in operation 275 to determine whether the power cord of the refrigeration system is plugged in. If it is determined in operation 275 that the power cord of the refrigeration system is plugged in, method 200 proceeds to operation 277. Otherwise, method 200 proceeds to operation 276 where an alert is sent for display on a user device to check a power cord of the refrigeration system.

At operation 277, method 200 determines whether a circuit breaker of the refrigeration system is turned on. In some embodiments, a camera may be used in operation 277 to determine whether the circuit breaker of the refrigeration system is turned on. If it is determined in operation 277 that the circuit breaker of the refrigeration system is turned on, method 200 proceeds to operation 280. Otherwise, method 200 proceeds to operation 278 where an alert is sent for display on a user device to check a circuit breaker of the refrigeration system.

At operation 280, method 200 determines from the acoustic data whether measured acoustic signals of the compressor of the refrigeration system are within a predetermined acoustic range. If the acoustic signals of the compressor of the refrigeration system are within the predetermined acoustic range, method 200 proceeds to operation 282. If the acoustic signals of the compressor of the refrigeration system are not within the predetermined acoustic range, method 200 proceeds to operation 290.

In operation 282, method 200 checks if an evaporator coils of the compressor of the refrigeration system needs cleaning. After operations 282, method 200 proceeds to operation 285 where an alert is sent for display on a user device that indicates that the refrigeration system needs servicing and that the compressor is functioning properly. After operation 285, method 200 may end.

In operation 290, an alert is sent for display on a user device that indicates that the refrigeration system needs servicing and that the compressor is not functioning properly. After operation 290, method 200 may end.

Modifications, additions, or omissions may be made to the methods described herein without departing from the scope of the disclosure. The methods may include more, fewer, or other steps. Additionally, steps may be performed in any suitable order. That is, the steps of any method disclosed herein do not have to be performed in the exact order disclosed, unless explicitly stated.

As used in this document, "each" refers to each member of a set or each member of a subset of a set. Furthermore, as used in the document "or" is not necessarily exclusive and, unless expressly indicated otherwise, can be inclusive in certain embodiments and can be understood to mean "and/or." Similarly, as used in this document "and" is not necessarily inclusive and, unless expressly indicated otherwise, can be inclusive in certain embodiments and can be understood to mean "and/or." All references to "a/an/the element, apparatus, component, means, step, etc." are to be interpreted openly as referring to at least one instance of the element, apparatus, component, means, step, etc., unless explicitly stated otherwise.

Furthermore, reference to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

The embodiments disclosed herein are only examples, and the scope of this disclosure is not limited to them. Particular embodiments may include all, some, or none of the components, elements, features, functions, operations, or steps of the embodiments disclosed herein. Certain embodiments are in particular disclosed in the attached claims directed to a method, a storage medium, a system and a computer program product, wherein any feature mentioned in one claim category, e.g. method, can be claimed in another claim category, e.g. system, as well. The dependencies or references back in the attached claims are chosen for formal reasons only. However, any subject matter resulting from a deliberate reference back to any previous claims (in particular multiple dependencies) can be claimed as well, so that any combination of claims and the features thereof are disclosed and can be claimed regardless of the dependencies chosen in the attached claims. The subject-matter which can be claimed comprises not only the combinations of features as set out in the attached claims but also any other combination of features in the claims, wherein each feature mentioned in the claims can be combined with any other feature or combination of other features in the claims. Furthermore, any of the embodiments and features described or depicted herein can be claimed in a separate claim and/or in any combination with any embodiment or feature described or depicted herein or with any of the features of the attached claims.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

What is claimed is:

1. A system comprising:

a door sensor configured to provide a door status of whether a door of a refrigeration system is open or closed;

a temperature sensor configured to measure a temperature of a food compartment of the refrigeration system;

a power sensor configured to measure an amount of power consumed by the refrigeration system;

a compressor sensor configured to provide acoustic data about a compressor of the refrigeration system; and a remote computing system comprising a processor configured to:

receive the door status, the temperature of the food compartment, the amount of power consumed by the refrigeration system, and the compressor data;

determine whether the temperature of the food compartment of the refrigeration system is above a predetermined temperature;

when the temperature of the food compartment of the refrigeration system is determined to be above the predetermined temperature, determine from the door status whether the door of the refrigeration system is open or closed;

when the door of the refrigeration system is determined to be closed, determine whether the amount of power consumed by the refrigeration system is within a predetermined power range;

when the amount of power consumed by the refrigeration system is determined to be within the predetermined power range, determine from the acoustic data whether measured acoustic signals of the compressor of the refrigeration system are within a predetermined acoustic range; and when the measured acoustic signals of the compressor of the refrigeration system are determined to be within the predetermined acoustic range, send an alert for display on a user device, the alert indicating that the refrigeration system needs servicing.

2. The system of claim 1, wherein the alert further indicates that the compressor is functioning properly.

3. The system of claim 1, wherein the processor is further configured to:

when the door of the refrigeration system is determined to be open, send a second alert for display on the user device, the second alert indicating that the door is open.

4. The system of claim 1, wherein the processor is further configured to:

when the measured acoustic signals of the compressor of the refrigeration system are determined to not be within the predetermined acoustic range, send a second alert for display on a user device, the second alert indicating:

that the refrigeration system needs servicing; and that the compressor is not functioning properly.

5. The system of claim 1, wherein the processor is further configured to:

when the amount of power consumed by the refrigeration system is determined to not be within the predetermined power range, send a second alert for display on the user device, the second alert indicating to check a power cord of the refrigeration system.

6. The system of claim 1, wherein the acoustic data comprises:

a frequency of the measured acoustic signals of the compressor of the refrigeration system; and a magnitude of the measured acoustic signals of the compressor of the refrigeration system.

7. The system of claim 1, wherein the processor is further configured to automatically send one or more instructions to the refrigeration system when the door of the refrigeration system is determined to be open or the amount of power consumed by the refrigeration system is determined to not be within the predetermined power range, the one or more instructions comprising:

an instruction that causes one more lights of the refrigeration system to blink; and an instruction that causes an alarm of the refrigeration system to sound.

8. The system of claim 1, wherein the processor is further configured to automatically send one or more instructions to the refrigeration system when the measured acoustic signals of the compressor of the refrigeration system are determined to not be within the predetermined acoustic range, the one or more instructions operable to cause the refrigeration system to switch to an off mode.

9. A method by one or more computer systems, the method comprising:

receiving, from a door sensor, a door status of whether a door of a refrigeration system is open or closed;

receiving, from a temperature sensor, a temperature of a food compartment of the refrigeration system;

receiving, from a power sensor, an indication of an amount of power consumed by the refrigeration system;

receiving, from a compressor sensor, acoustic data about a compressor of the refrigeration system;

determining whether the temperature of the food compartment of the refrigeration system is above a predetermined temperature;

when the temperature of the food compartment of the refrigeration system is determined to be above the predetermined temperature, determining from the door status whether the door of the refrigeration system is open or closed;

when the door of the refrigeration system is determined to be closed, determining whether the amount of power consumed by the refrigeration system is within a predetermined power range;

when the amount of power consumed by the refrigeration system is determined to be within the predetermined power range, determining from the acoustic data whether measured acoustic signals of the compressor of the refrigeration system are within a predetermined acoustic range; and when the measured acoustic signals of the compressor of the refrigeration system are determined to be within the predetermined acoustic range, sending an alert for display on a user device, the alert indicating that the refrigeration system needs servicing.

10. The method of claim 9, wherein the alert further indicates that the compressor is functioning properly.

11. The method of claim 9, further comprising:

when the door of the refrigeration system is determined to be open, sending a second alert for display on the user device, the second alert indicating that the door is open.

12. The method of claim 9, further comprising:

when the measured acoustic signals of the compressor of the refrigeration system are determined to not be within the predetermined acoustic range, sending a second alert for display on a user device, the second alert indicating:

that the refrigeration system needs servicing; and that the compressor is not functioning properly.

13. The method of claim 9, further comprising:

when the amount of power consumed by the refrigeration system is determined to not be within the predetermined power range, sending a second alert for display on the user device, the second alert indicating to check a power cord of the refrigeration system.

14. The method of claim 9, further comprising sending one or more instructions to the refrigeration system when the measured acoustic signals of the compressor of the refrigeration system are determined to not be within the predetermined acoustic range, the one or more instructions operable to cause the refrigeration system to switch to an off mode.

15. One or more computer-readable non-transitory storage media embodying software that is operable when executed to:

receive, from a door sensor, a door status of whether a door of a refrigeration system is open or closed;

receive, from a temperature sensor, a temperature of a food compartment of the refrigeration system;

receive, from a power sensor, an indication of an amount of power consumed by the refrigeration system;

receive, from a compressor sensor, acoustic data about a compressor of the refrigeration system;

determine whether the temperature of the food compartment of the refrigeration system is above a predetermined temperature;

when the temperature of the food compartment of the refrigeration system is determined to be above the predetermined temperature, determine from the door status whether the door of the refrigeration system is open or closed;

when the door of the refrigeration system is determined to be closed, determine whether the amount of power consumed by the refrigeration system is within a predetermined power range;

when the amount of power consumed by the refrigeration system is determined to be within the predetermined power range, determine from the acoustic data whether measured acoustic signals of the compressor of the refrigeration system are within a predetermined acoustic range; and when the measured acoustic signals of the compressor of the refrigeration system are determined to be within the predetermined acoustic range, send an alert for display on a user device, the alert indicating that the refrigeration system needs servicing.

16. The computer-readable non-transitory storage media of claim 15, wherein the alert further indicates that the compressor is functioning properly.

17. The computer-readable non-transitory storage media of claim 15, wherein the software is further operable when executed to:

when the door of the refrigeration system is determined to be open, sending a second alert for display on the user device, the second alert indicating that the door is open.

18. The computer-readable non-transitory storage media of claim 15, wherein the software is further operable when executed to:

when the measured acoustic signals of the compressor of the refrigeration system are determined to not be within the predetermined acoustic range, send a second alert for display on a user device, the second alert indicating:

that the refrigeration system needs servicing; and that the compressor is not functioning properly.

19. The computer-readable non-transitory storage media of claim 15, wherein the software is further operable when executed to:

when the amount of power consumed by the refrigeration system is determined to not be within the predetermined power range, send a second alert for display on the user device, the second alert indicating to check a power cord of the refrigeration system.

20. The computer-readable non-transitory storage media of claim 15, wherein the software is further operable when executed to send one or more instructions to the refrigeration system when the measured acoustic signals of the compressor of the refrigeration system are determined to not be within the predetermined acoustic range, the one or more instructions operable to cause the refrigeration system to switch to an off mode.

* * * * *